US011501960B2

(12) United States Patent
Groopman et al.

(10) Patent No.: US 11,501,960 B2
(45) Date of Patent: Nov. 15, 2022

(54) RESONANCE IONIZATION FILTER FOR SECONDARY ION AND ACCELERATOR MASS SPECTROMETRY

(71) Applicant: The Government of the United States of America, as represented by the Secretary of the Navy, Arlington, VA (US)

(72) Inventors: Evan E. Groopman, Alexandria, VA (US); David G. Willingham, Falls Church, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 129 days.

(21) Appl. No.: 17/215,179

(22) Filed: Mar. 29, 2021

(65) Prior Publication Data

US 2021/0366698 A1 Nov. 25, 2021

Related U.S. Application Data

(60) Provisional application No. 63/028,836, filed on May 22, 2020.

(51) Int. Cl.

| | |
|---|---|
| ***H01J 49/00*** | (2006.01) |
| ***H01J 49/06*** | (2006.01) |
| ***H01J 49/40*** | (2006.01) |
| ***H01J 49/32*** | (2006.01) |

(52) U.S. Cl.
CPC ..... *H01J 49/0031* (2013.01); *H01J 49/061* (2013.01); *H01J 49/067* (2013.01); *H01J 49/324* (2013.01); *H01J 49/401* (2013.01)

(58) Field of Classification Search
CPC .... H01J 49/0031; H01J 49/061; H01J 49/067; H01J 49/401; H01J 49/162; H01J 49/324
USPC ..... 250/281, 282
See application file for complete search history.

(56) References Cited

U.S. PATENT DOCUMENTS 5,101,105 A * 3/1992 Fenselau ..... H01J 49/145 250/281

OTHER PUBLICATIONS

Groopman, Evan E., et al. "An overview of NRL's NAUTILUS: a combination SIMS-AMS for spatially resolved trace isotope analysis" Journal of analytical atomic spectrometry 35.3 (2020): 600-625.

(Continued)

*Primary Examiner* — Kiet T Nguyen
(74) *Attorney, Agent, or Firm* — US Naval Research Laboratory; Stephen T. Hunnius

(57) ABSTRACT

A method of removing nuclear isobars from a mass spectrometric technique comprising directing ions, decelerating the ions, neutralizing a first portion of the ions, creating residual ions and a second portion of the ions, reionizing a selective portion of the ions, re-accelerating the selective reionized portion of ions, and directing the reionized portion of ions to a detector. An apparatus to remove nuclear isobars comprising a deceleration lens, an equipotential surface, an electron source to neutralize a portion of the ion beam, a deflector pair, a tunable resonance ionization laser for selective resonant reionization, and an acceleration lens.

16 Claims, 6 Drawing Sheets

(56) References Cited

OTHER PUBLICATIONS

Liu, Ming-Chang, et al. "The Hyperion-Il radio-frequency oxygen ion source on the UCLA ims1290 ion microprobe Seam characterization and applications in geochemistry and cosmochemistry." International Journal of Mass Spectrometry 424 (2018): 1-9.
Savina, Michael R., et al. "New resonance ionization mass spectrometry scheme for improved uranium analysis." Analytical chemistry 90.17 (2018): 10551-10558.
Stephan, Thomas, et al. "Strontium and barium isotopes in presolar silicon carbide grains measured with CHILI—two types of X grains" Geochimica et Cosmochimica Acta 221 (2018): 109-126.

* cited by examiner

RESONANCE IONIZATION FILTER FOR SECONDARY ION AND ACCELERATOR MASS SPECTROMETRY

REFERENCE TO RELATED APPLICATION

This application is a non-provisional of, and claims priority to and the benefits of, U.S. Provisional Patent Application No. 63/028,836 filed on May 22, 2020, the entirety of which is herein incorporated by reference.

BACKGROUND

This disclosure concerns a device and method to select an isotope/element of interest by removing nuclear isobars from mass spectrometric techniques—such as secondary ion mass spectrometry (SIMS), and coupled SIMS-accelerator mass spectrometry (AMS)—through the addition of a resonance ionization filter (RIF).

The RIF allows for the discrimination of nuclear isobars (analytical interferences) in-situ, without requiring separation chemistry.

This new device and method allow for maintaining the petrologic context of samples during analysis. For small (micrometer-sized) samples, there are no alternatives to this technique, since chemistry is not feasible.

The RIF will perform ion beam neutralization followed by resonant reionization (using tunable lasers) prior to ion beam detection.

Mass spectrometers, such as dynamic SIMS instruments, generate ion beams from samples under high vacuum and filter the ions by mass-to-charge ratio prior to detection. SIMS employs a beam of energetic "primary" ions (0.5-20 keV) to bombard the sample and sputter atoms from the sample surface. A small fraction of these atoms are ionized during the sputtering process.

Mass spectrometry (MS) cannot resolve isotopes of 2+ elements with the same mass (nuclear isobars).

In addition to atomic ions, molecular ions may also be produced from the sample. Therefore, it is routine to have interferences at the same nominal mass-to-charge ratio of an isotope of interest, either from a molecular ion or from a nuclear isobar. The magnitude of the interferences often depends upon the composition of the sample, and in some cases may be corrected for or adequately filtered. It is often the case, however, that nuclear isobars (e.g., $^{87}$Rb and $^{87}$Sr) cannot be measured by increasing the mass resolving power (MRP, typically defined as the full width at 10% peak height) of the mass spectrometer because of the simultaneous loss of ion transmission (essentially making the signals undetectable or highly imprecise).

The generally accepted method for removing nuclear isobaric interferences in mass spectrometry is to perform separation chemistry on the sample prior to measurement (e.g., by inductively coupled plasma (ICP)-MS, thermal ionization MS (TIMS), or AMS), however this results in a loss petrologic context of the sample; furthermore, chemistry is not practical for individual microanalytical samples routinely measured by SIMS (e.g., micrometer-sized particles).

Resonance ionization MS (RIMS) uses 2-3 tunable lasers each to resonantly ionize individual elements from a neutral plume of atoms above a sample surface (generated by laser desorption or ion bombardment) prior to detection in a time-of-flight (ToF) MS. Since the spectroscopy is element-specific, nuclear isobars may be removed. Resonance ionization is many orders of magnitude more efficient than non-resonant ionization, so RIMS typically achieves high selectivity. However, RIMS is challenged by non-resonant ionization and molecules within the sample plume for many matrices (such as oxides), and the technical challenge of overlapping the ionization lasers with the expanding plume above the sample while achieving saturation of the atomic excited states.

The duty cycle of ToF-MS instrument is very low compared to dynamic SIMS, which can affect instrument stability and precision over long measurements.

Our invention mitigates the drawbacks of SIMS and RIMS by adding a RIF to a SIMS instrument, yielding atomically and elementally specific measurements from micrometer-sized volumes of material.

SUMMARY OF DISCLOSURE

Description

This disclosure teaches a device and method to select an isotope/element of interest by removing nuclear isobars from mass spectrometric techniques—such as secondary ion mass spectrometry (SIMS), and coupled SIMS-accelerator mass spectrometry (AMS)—through the addition of a resonance ionization filter (RIF).

The RIF allows for the discrimination of nuclear isobars (analytical interferences) in-situ, without requiring separation chemistry.

Our invention mitigates the drawbacks of SIMS and RIMS by adding a RIF to a SIMS instrument, yielding atomically and elementally specific measurements from micrometer-sized volumes of material.

DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description when considered in conjunction with the drawings.

DETAILED DESCRIPTION OF THE INVENTION

This disclosure teaches methods and devices to select an isotope/element of interest by removing nuclear isobars from mass spectrometric techniques—such as secondary ion mass spectrometry (SIMS), and coupled SIMS-accelerator mass spectrometry (AMS)—through the addition of a resonance ionization filter (RIF).

The RIF allows for the discrimination of nuclear isobars (analytical interferences) in-situ, without requiring separation chemistry.

Our invention mitigates the drawbacks of SIMS and RIMS by adding a RIF to a SIMS instrument, yielding atomically and elementally specific measurements from micrometer-sized volumes of material.

Example 1

The RIF will incorporate four processes that in combination remove nuclear isobars from SIMS-like ion beams—deceleration, neutralization, resonant reionization, and re-acceleration—prior to ion detection.

Figure 1:
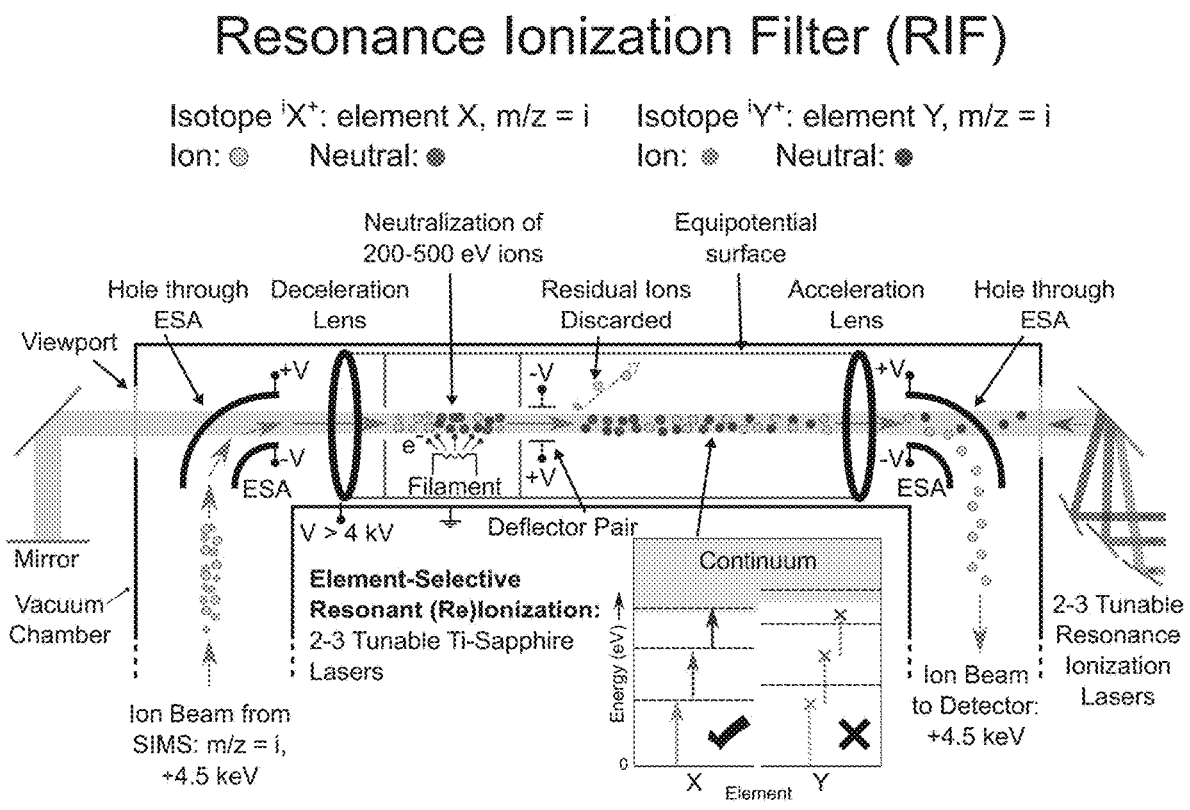
FIG. 1 illustrates a schematic of the resonance ionization filter (RIF). Mass-filtered ions of a single mass-to-charge ratio (m/z) are decelerated, neutralized, resonantly reionized, and reaccelerated to selectively isolate a specific isotope.

FIG. 1 shows a schematic of the RIF.

Neutralization of the SIMS ion beam is performed using an electron source (e.g., W filament or plasma) or a gas cell.

Following the neutralizer, a set of deflector plates will be used to deflect any non-neutralized beam fraction into a detector for a measure of neutralization efficiency and to ensure that ions reentering the NAUTILUS beamline are only those that have been resonantly reionized.

The lasers for a resonance ionization system are pulsed at a specific repetition rate, while the ion signal from the dynamic SIMS is continuous.

Deceleration of the 4.5 keV SIMS ions down to a few hundred eV is therefore required to maximize the flight time of the ions in the RIF and increase the interaction probability with the pulsed lasers.

Higher laser frequencies and longer transit times will increase the overall efficiency of the system.

Following reionization, accelerating and focusing optics will allow for higher efficiency detection of the ions. The region between the deceleration and acceleration lenses will contain an equipotential surface biased at the deceleration voltage so that reionized atoms are not accelerated towards any other potentials prior to arriving at the acceleration lenses.

The RIF will be housed in a high-vacuum beamline.

The SIMS or a similar type of mass spectrometer will be used in its conventional manner to mass- and energy-filter a beam of sample ions.

The resulting ion beam will have an energy typically between 4.5-10 keV depending upon the parameters of the SIMS, and will be of a single m/z. This m/z ion beam may contain atomic ions of different elements (e.g., $^{160}Gd^{+}$ and $^{160}Dy^{+}$) and molecular ion species (e.g., $^{160}[^{144}Nd^{16}O]^{+}$ and $^{160}[^{144}Sm^{16}O]^{+}$).

This ion beam will be electrostatically steered into a U-shaped vacuum system and bent by a spherical or cylindrical electrostatic analyzer (ESA) (FIG. 1). Using ESAs before and after the RIF allows for the lasers to be shone coaxially to the neutralized ion beam, which maximizes the interaction cross section. The lasers will be shown through quartz viewports and reflected by mirrors to increase the number of laser passes through the atom beam. Two-to-three lasers will be used to resonantly and selectively ionize a single element (e.g., $^{160}Gd$), leaving the remaining atoms to be discarded.

Each element of a nuclear isobar (e.g., $^{160}Gd$ or $^{160}Dy$) may be serially reionized and counted by alternating shots of the reionization lasers (2-3 per element). Several different lasers are commercially available to be used (with modification) for the system. The choice of laser impacts the design geometry of the RIF and the overall efficiency of the system.

Examples of laser characteristics are shown in Table 1.

TABLE 1

Comparison of available laser parameters.

| Name/Source | Frequency (Hz) | Average Power (W) | Pulse Width (ns) |
|---|---|---|---|
| Photonix TU-L | 1000 | 1.7 | 15 |
| Photonix TU-H | 4000 | 1.7 | 30-50 |
| Radiant Dyes | 10,000 | 1.3-2.7 | 30-40 |
| Under Development* | 3000 | 5 | 15 |

The RIF can be added to any dynamic SIMS instrument in place of an ion detector. At the U.S. Naval Research Laboratory (NRL) we insert a RIF in between our combination SIMS-AMS instrument (NAUTILUS), to remove nuclear isobars prior to AMS molecule filtering and detection.

Example 2

We estimate the efficiency of the system we designed for the NAUTILUS (based on equations 1-5) to be up to 80% based upon the types of lasers available and calculations of the ion beam profile from the SIMS (i.e. a loss of only 20% of the ions of interest).

Ion optical models of the SIMS ion beam using SIMION were fed into the equations below (e.g., beam size, energy, dispersion, etc.). We calculated the efficiency of the reionization component of the RIF by determining the residence time of the neutrals in the drift tube (Eq. 1), each laser's irradiance (power density) (Eq. 2), the number of laser pulses per neutral in the drift tube (Eq. 3), the ionization probability (Eq. 4), and the overall efficiency (Eq. 5). Note, units have been stripped from the following equations for clarity. For all equations: L=drift length, V=ion/neutral energy, M=atom mass, p=average laser power, f=laser frequency, w=laser pulse width, s=laser beam size, t=residence time of atoms overlapping the laser, n=# of laser pulses per atom, E=laser irradiance, S=the saturation irradiance (spectroscopic and atom-dependent parameter), IP=the ionization probability, and O=the spatial overlap fraction between the laser and neutral atom beam. (Note that Eq. 4 is an approximation and is generally correct to <1%.) The overall efficiency depends upon the precise choice of laser system and ion beam energy.

An examination of the efficiency equation (Eq. 5) shows that at its core, it depends most on the laser irradiance, laser frequency, and residence time. Laser frequency and irradiance are often inversely related.

Example 3

Figure 2:
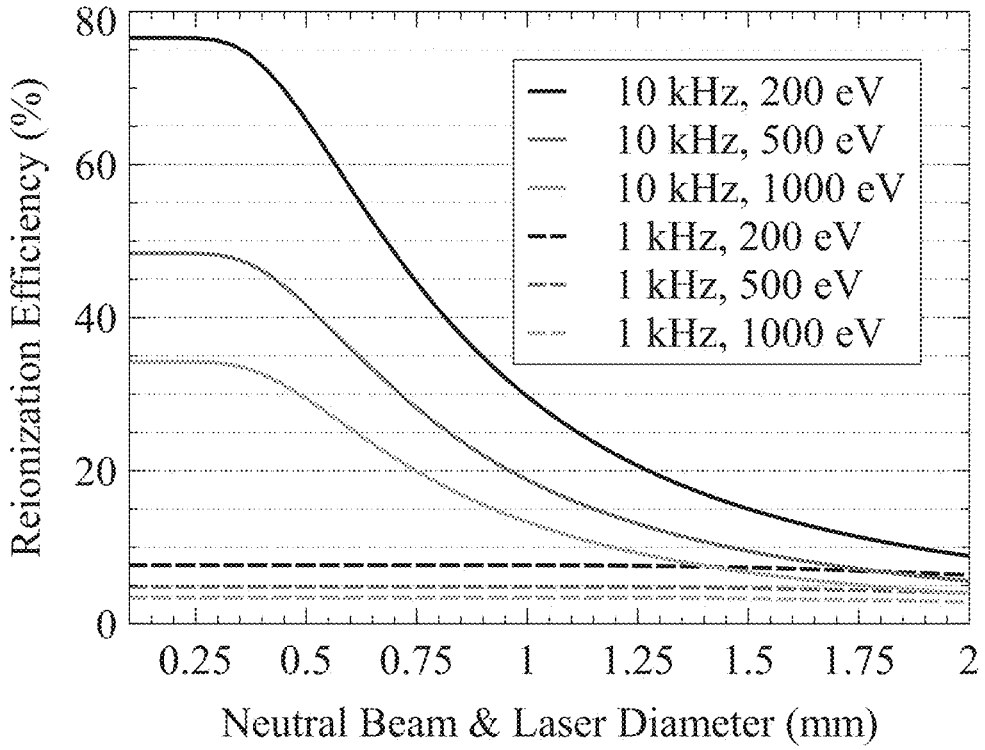
FIG. 2 illustrates reionization efficiency for 1 kHz and 10 kHz lasers relative to neutral beam diameter. Simulation based upon a 1.5 m long drift tube with atoms of mass 100 amu. Differences in transit time (due to ion energy, drift length, mass) affect the interaction efficiency.

FIG. 2 shows the effects of the neutral beam and laser diameters relative to the reionization efficiency of the RIF for a mass 100 amu atom over a 1.5 m drift length with a saturation irradiance of 2 MW/cm$^2$. The transit time of the atom, and therefore the efficiency, depends upon the decelerated ion energy, the drift length, and the atom mass (see different curves for each laser frequency).

FIG. 2 also shows the dramatically different sensitivity to neutral beam size between the two laser frequencies. This arises from the difference in irradiance between the two lasers: 0.25 MW/cm$^2$ for the 10 kHz system and 3.61 MW/cm$^2$ for the 1 kHz.

The 10 kHz system experiences a significant efficiency boost with smaller neutral beam diameters due to its lower irradiance, though this effect saturates below 0.4 mm.

In contrast, the 1 kHz system is hardly influenced by the neutral beam diameter because its irradiance is already high, but it is limited by a low repetition rate, which results in only 8% of the atoms receiving a laser pulse as they transit the 1.5 m drift tube, as opposed to 77% for the 10 kHz system.

The example underpins the essential optimization of the RIF. If the RIF were based upon a 10 kHz laser setup, the most significant optimization would involve making the neutral beam size as small as possible, though this could require higher energy ions and therefore lower residence time.

If the RIF were based upon a 1 kHz laser, beam diameter has a less significant effect, and most optimization would center around increasing the residence time.

In both cases the drift tube length and ion energies would be modified to maximize efficiency and beam overlap.

$$\text{Residence Time}(t) = \frac{L}{\sqrt{2V/M}} \tag{1}$$

$$\text{Irradiance}(E) = \frac{p}{\left(f \cdot w \cdot \pi(s/2)^2\right)} \tag{2}$$

$$\text{Pulses/atom}(n) = f \times t \tag{3}$$

$$\text{Ionization Probability}(IP) = \begin{cases} \text{If } n < 1\text{: } 1 - \exp(E/S) \\ \text{If } n > 1\text{: } 1 - \exp(n \cdot E/S) \end{cases} \tag{4}$$

$$\text{Efficiency} = IP \cdot O \tag{5}$$

Example 4

Figure 3:
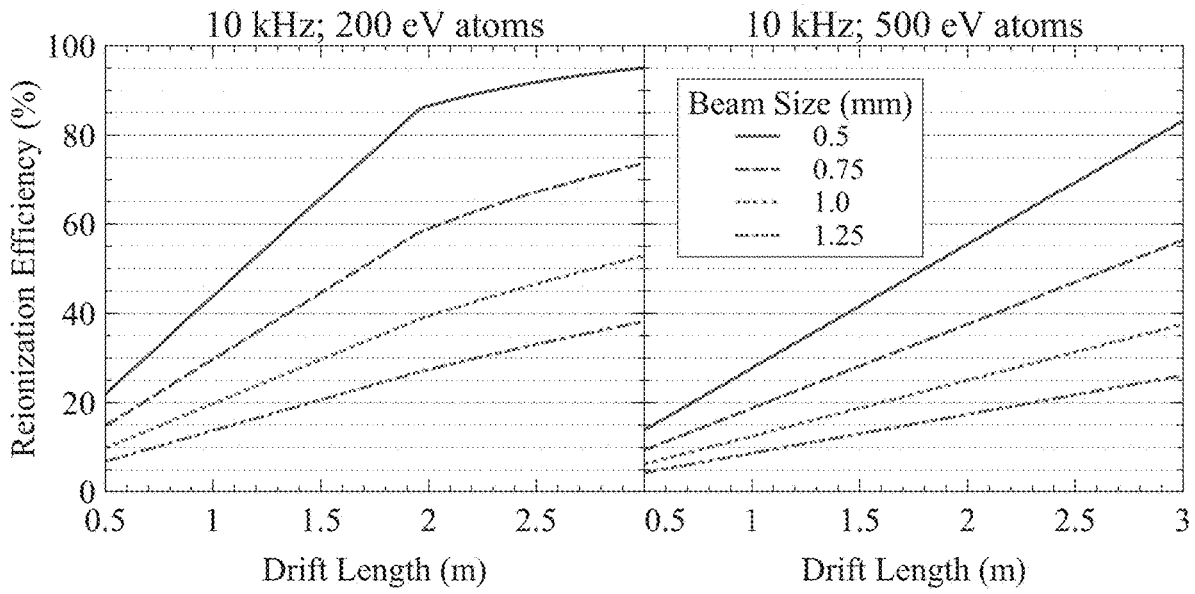
FIG. 3 illustrates efficiency comparison of four laser systems for different neutral and laser beam diameters. 100 u atoms over a 1.5 m drift tube length with 2 MW/cm$^2$ saturation irradiance.

FIG. 3 Figure shows a comparison of the three commercial systems and the expected performance of the high-power system under development.

Based upon preliminary SIMION models of the deceleration and focusing system, ion/neutral beam sizes of 0.25-0.5 mm for 500 eV ions, and 0.5-1 mm for 200 eV ions are achievable in the RIF. A modified SIMION model of the Cameca ims 4f was used to simulate ions entering the RIF. For the commercial systems, higher laser frequency results in higher efficiency. The developmental high-power 3 kHz system is advantageous where the neutral beam size cannot be constrained as well.

Example 5

Case #1: V=200 eV, L=1.5 m, s=1 mm, S=2 MW/cm$^2$, M=100 u
Residence Time (t)=76 μs
Irradiance (E)=0.98 MW/cm$^2$
Pulses/atom (n)=0.77
Ionization Probability (IP)=39%
Efficiency=30%

Example 6

Case #2: V=500 eV, L=1.5 m, s=0.5 mm, S=2 MW/cm$^2$, M=100 u
Residence Time (t)=48 μs
Irradiance (E)=3.9 MW/cm$^2$
Pulses/atom (n)=0.48
Ionization Probability (IP)=86%
Efficiency=42%

Example 7

Case #3: V=500 eV, L=3 m, s=0.5 mm, S=2 MW/cm$^2$, M=100 u
Residence Time (t)=97 μs
Irradiance (E)=3.9 MW/cm$^2$
Pulses/atom (n)=0.97
Ionization Probability (IP)=86%
Efficiency=83%

The three previous example cases above illustrate potential design parameters.

All cases assume the use of Radiant Dyes 10 kHz lasers.

Case #1 uses a low-energy (200 eV) atom beam over a 1.5 m drift length, with a laser and atom beam size of 1 mm for a total efficiency of 30%.

Case #2 uses more energetic 500 eV atoms to decrease the beam size (more energetic ions are easier to focus), which yields a lower residence time and fewer laser pulses/atom, but greatly increases the irradiance and ionization probability.

In Case #3, the drift length is increased for the 500 eV atoms, which increases the number of laser pulses/atom, and therefore the overall efficiency.

Optimization of these parameters via simulations is possible. Efficiencies of several 10s of percent are easily achievable. Even this level of efficiency will have immediate impact as it will enable previously unachievable measurements.

Other considerations include the specific tuning of the SIMS instrument that acts as an injector into the RIF.

Higher energy bandwidth (SIMS energy slit) increases the transmission through the SIMS, though this comes at a cost of increased angular and energy dispersion in the RIF, which could reduce RIF efficiency.

Smaller beam sizes in the RIF are achievable using a lower SIMS energy bandpass. Depending on the laser system employed, this would be one more optimization parameter for the NAUTILUS-RIF system.

Figure 4:
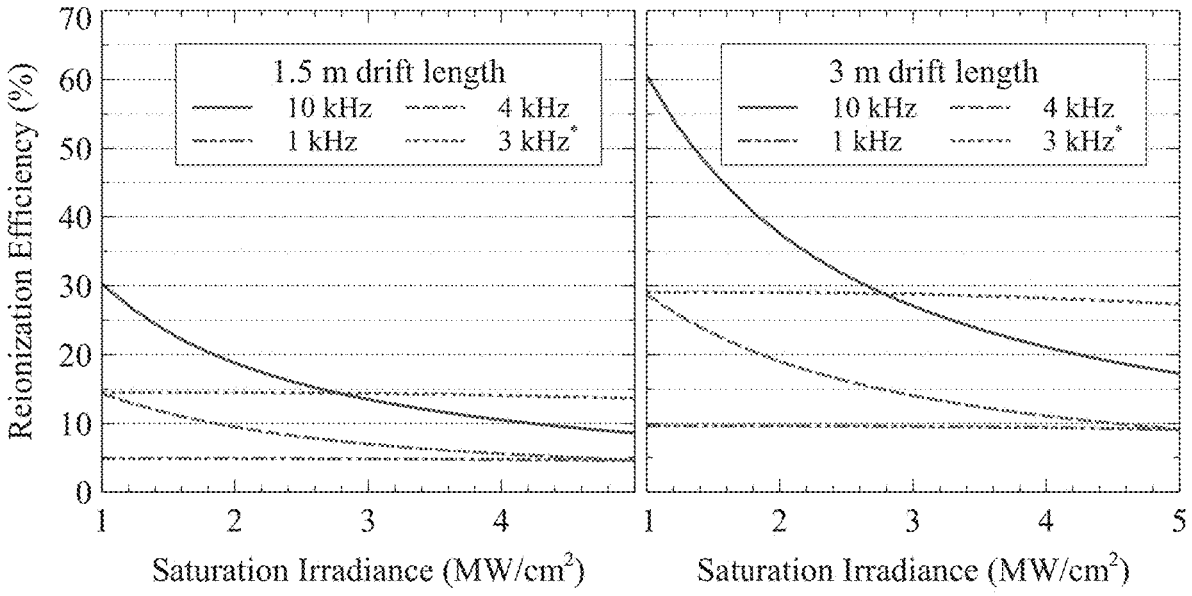
FIG. 4 is an illustration of the effect of saturation irradiance and drift length on overall efficiency for 100 u, 500 eV neutrals and a 1 mm beam diameter. Picking the correct scheme is important to reduce saturation irradiance.
Figure 5:
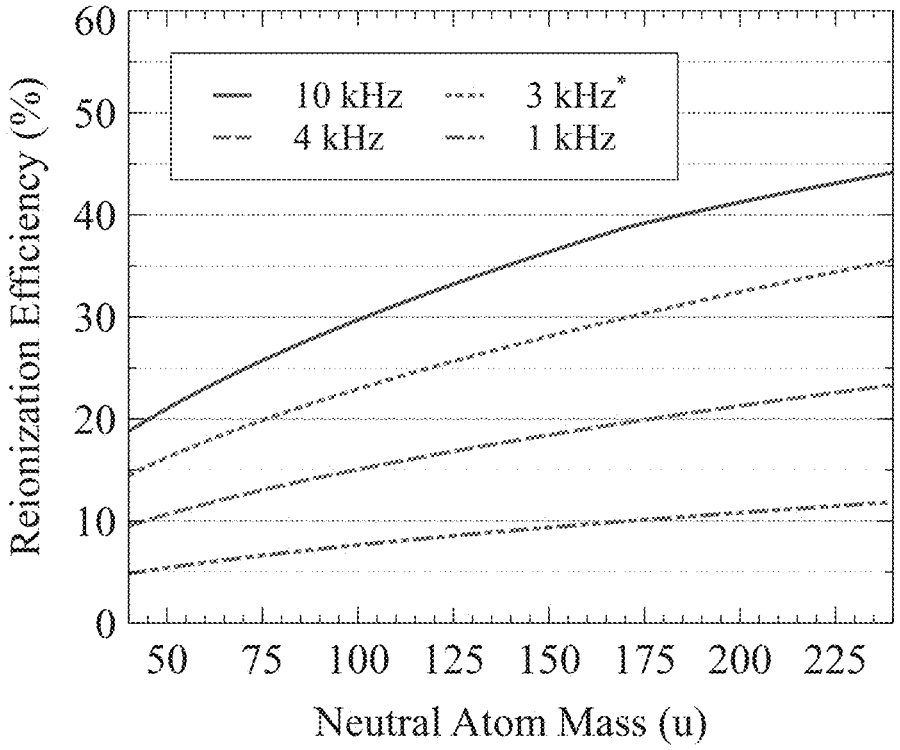
FIG. 5 illustrates RIF efficiency versus neutral atom mass for a 1 mm, 200 eV beam across a 1.5 m drift length. Higher mass atoms have lower velocities and higher residence times, therefore higher efficiency.

FIG. 4 illustrates the effect of saturation irradiance and drift length of overall efficiency for the four lasers and a conservative 1 mm, 500 eV neutral beam. The saturation irradiance for an element is related to choosing the right ionization scheme, which increases efficiency. These schemes can be adapted to the present case of neutrals with a significant velocity component along the laser beam direction. The Doppler shift is easily accounted for, and in fact collinear laser resonance ionization spectroscopy based on velocity tuning has advantages in counteracting isotopic fractionation caused by the energy spread of the neutral beam. Atomic mass also affects the RIF efficiency, with heavier, slower atoms having higher residence times and higher efficiencies, as shown in FIG. 5.

This Resonance Ionization Filter (RIF) invention allows for nuclear isobars to be distinguished on SIMS and SIMS-like mass spectrometers.

Figure 6:
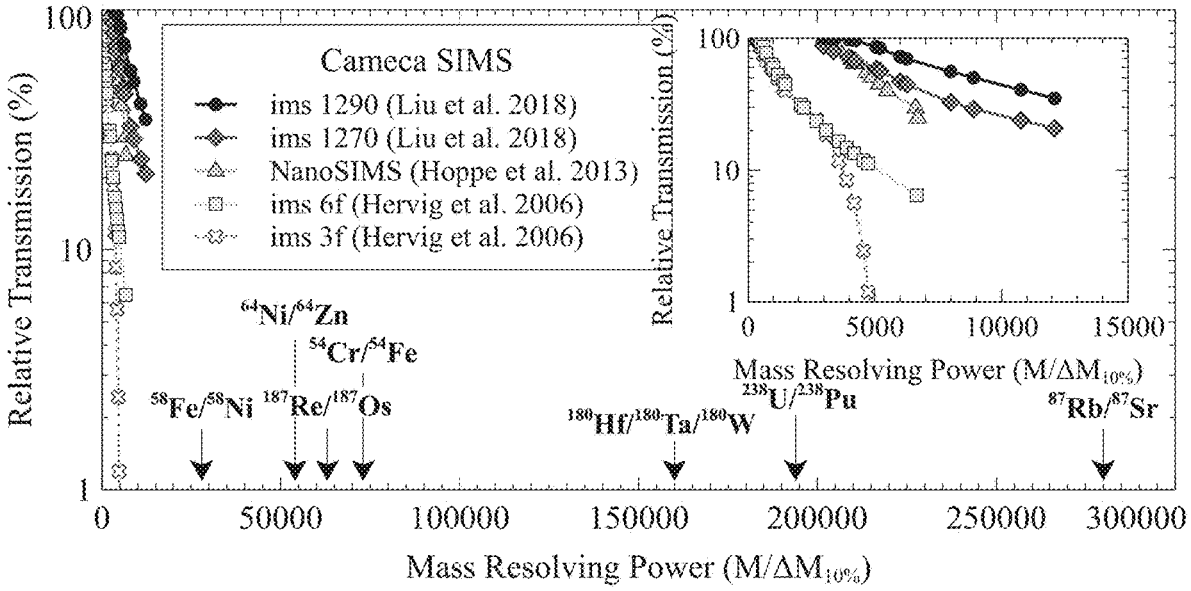
FIG. 6 illustrates relative transmission versus MRP (10% peak height) for Cameca SIMS instruments. Most nuclear and molecular isobars above mass 40 are not easily separable while retaining instrument sensitivity. MRP requirements for some nuclear isobars indicated by arrows above. The NRL NAUTILUS efficiently eliminates all molecular isobars at a cost of 20-50% transmission, regardless of MRP requirements.

It is currently impractical for the prior art or state-of-the-art SIMS instruments such as the Ametek Cameca ims 1300, ims 7f, or NanoSIMS 50(L) to separate nuclear isobars requiring a MRP>20,000 (and often >6000-10,000) (FIG. 6). This is because ion transmission is severely diminished by increasing mass resolving power (e.g., closing slits and apertures in the mass spectrometer), to the point where there is not enough signal to perform a measurement. High MRP also decreases instrument stability.

Therefore, the only way to separate nuclear isobars above mass ~50 on a SIMS is to use spectroscopy, such as described in the RIF invention. The RIF enables completely new measurements that have never been achieved on a SIMS or from micrometer-scale samples.

In geochronology, cosmochemistry, nuclear forensics, and materials science, there are plentiful examples of measurements that could only, prior to this invention, be performed on bulk samples using chemistry and pre-concentration. These include measurements of many short- and long-lived radiochronometers, such as Rb—Sr and Re—Os, and fission product abundance measurements.

The SIMS+RIF combination provides several advantages relative to standalone RIMS in particular. As mentioned previously, the molecular complement of the neutral sample plume in RIMS can have two adverse effects: (1) photofragmentation and non-resonant ionization can yield isobaric interferences and affect instrument mass fractionation, and (2) laser ablated or sputtered sample atoms that remain bound in molecules are lost from the measurement because they are not resonantly ionized.

By mass-filtering the ion beam with SIMS prior to the RIF, the overall background of molecule species will be greatly reduced in the RIF.

In addition, nearly all molecular and atomic ions entering the RIF will be neutralized, with essentially only a specific element reionized and detected.

This would dramatically reduce or eliminate the typical molecular background in SIMS in addition to separating out nuclear isobars.

In RIMS the ionization lasers are typically overlapped and shone orthogonally to the expanding sample neutral plume, which guarantees that much of the plume will be outside of the saturation overlap and will therefore not be ionized.

Here, the RIF uses a coaxial laser/atom beam design to maximize overlap and the interaction probability. SIMS is a continuous, high duty cycle technique, whereas RIMS has a low duty cycle necessary for ToF operation.

Here, with the coaxial laser design of the RIF, pulsed lasers still have multiple chances to saturate the neutral atom beam (this varies with the drift tube length).

The NRL NAUTILUS uses a single stage AMS system to eliminate molecules from SIMS ion beams. With the addition of the RIF, nuclear isobars are eliminated as well.

As mentioned, since the RIF would eliminate most molecules, the NAUTILUS AMS can operate with higher transmission due to the lower background. The AMS still provides a guarantee that no molecules would be present in the final signal (in case of some non-resonant ionization in the RIF).

Other prior art or state-of-the-art techniques that achieve elemental specificity (e.g., TIMS, ICP-MS, AMS) require bulk samples and/or chemical preparation prior to measurement.

In contrast, our technique does not require bulk samples and/or chemical preparation prior to measurement.

The SIMS+RIF and NAUTILUS+RIF systems retain the petrologic context of samples.

Additionally, samples smaller than can be treated by chemistry (e.g., micrometer-scale particles) are measured. Without chemistry or other additional sample preparation, the SIMS+RIF and NAUTILUS+RIF can analyze samples with elemental specificity more expediently than other techniques.

The design alternatives for the RIF invention rely primarily upon the choice of laser system used for resonant reionization, specifically the frequency and irradiance of the lasers. This choice affects the overall size and voltages required by the RIF. Ideally, the highest frequency and highest irradiance laser will be used to maximize efficiency.

A large number (>100s) and wide variety of SIMS and magnetic sector mass spectrometers are in use globally, especially in the areas of semiconductors/electronics, optics, national security, and cosmo/geochemistry.

Our RIF can be licensed to be an add-on capability to many of these instruments. Another goal of the RIF is to complement the capabilities of the instruments and not interfere with their OEM operation (e.g., to be an optional capability for specific measurements).

Our RIF is manufactured using commercial off-the-shelf (COTS) and in-house vacuum components (e.g., flanges, nipples, ports), high-voltage power supplies, ion optics, and lasers.

This Navy RIF invention eliminates nuclear isobaric interferences for SIMS-like microanalyses.

This Navy RIF improves standalone RIMS by decreasing non-resonant ionization and increasing laser overlap (efficiency).

This Navy RIF enables previously unachievable in-situ measurements.

The above examples are merely illustrative of several possible embodiments of various aspects of the present disclosure, wherein equivalent alterations and/or modifications will occur to others skilled in the art upon reading and understanding this specification and the annexed drawings. In addition, although a particular feature of the disclosure may have been illustrated and/or described with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

What we claim is:

1. A method of removing nuclear isobars from a mass spectrometric technique, comprising the steps of:

utilizing a mass spectrometer and ion beam to analyze a sample;

directing ions from the ion beam from the mass spectrometer through an electrostatic analyzer inside a vacuum chamber;

utilizing a deceleration lens;

decelerating the ions;

neutralizing a first portion of the ions;

creating residual ions and a second portion of the ions;

directing the residual ions and the second portion of the ions through a deflector pair;

discarding the residual ions;

utilizing selective resonant reionization to reionize a selective portion of the ions within the second portion of the ions and creating a reionized portion of ions and a second portion of residual ions;

utilizing an acceleration lens;

re-accelerating the reionized portion of ions;

allowing the second portion of residual ions to escape; and directing the selective portion of the ions to a detector.

2. The method of removing nuclear isobars from a mass spectrometric technique of claim 1, wherein the step of decelerating the ions decelerates the ions to 200-500 eV and wherein the step of neutralizing a first portion of the ions neutralizes the 200-500 eV ions.

3. The method of removing nuclear isobars from a mass spectrometric technique of claim 2, wherein the step of utilizing selective resonant reionization to reionize a selective portion of the ions within the second portion of the ions and creating a reionized portion of ions and a second portion of residual ions utilizes a tunable resonance ionization laser.

4. The method of removing nuclear isobars from a mass spectrometric technique of claim 3, wherein the tunable resonance ionization laser comprises a Ti-Sapphire laser.

5. The method of removing nuclear isobars from a mass spectrometric technique of claim 4, wherein the step of neutralizing a first portion of the ions from an ion beam from the mass spectrometer comprises an electron source or a gas cell.

6. The method of removing nuclear isobars from a mass spectrometric technique of claim 5, wherein the laser for the resonance ionization is pulsed at a repetition rate; and wherein the ion signal from the mass spectrometric technique is continuous.

7. The method of removing nuclear isobars from a mass spectrometric technique of claim 6, wherein the deceleration lens is an optical ion deceleration lens.

8. The method of removing nuclear isobars from a mass spectrometric technique of claim 7, wherein the acceleration lens is an optical ion acceleration lens.

9. The method of removing nuclear isobars from a mass spectrometric technique of claim 5, further comprising:

wherein the tunable resonance ionization laser comprises multiple Ti-Sapphire lasers; and wherein the electron source comprises a tungsten filament or plasma.

10. The method of removing nuclear isobars from a mass spectrometric technique of claim 3, wherein the deflector pair comprises a set of deflector plates; and further comprising the step of deflecting the residual ions or a non-neutralized beam fraction into a second detector;

measuring the neutralization efficiency; and confirming only the selective portion of ions are the only ions that have been resonantly reionized.

11. The method of removing nuclear isobars from a mass spectrometric technique of claim 3, wherein an equipotential surface is between the deceleration lens and acceleration lens; and further comprising the steps of biasing the equipotential surface at the deceleration voltage; and preventing reionized ions from accelerating towards any other potentials prior to arriving at the acceleration lens.

12. An apparatus to remove nuclear isobars from mass spectrometry, comprising:

a vacuum chamber;

an electrostatic analyzer inside the vacuum chamber;

an ion beam through the electrostatic analyzer inside the vacuum chamber;

a deceleration lens;

an equipotential surface;

a filament or electron source to neutralize a portion of the ion beam;

a deflector pair;

a tunable resonance ionization laser for selective resonant reionization; and an acceleration lens;

wherein the equipotential surface is between the deceleration lens and the acceleration lens; and wherein the acceleration lens accelerates a portion of the ion beam to a detector.

13. The apparatus to remove nuclear isobars from mass spectrometry of claim 12, wherein the filament or electron source neutralizes the ion beam to 200-500 eV ions.

14. The apparatus to remove nuclear isobars from mass spectrometry of claim 13, wherein the deflector pair discards residual ions.

15. The apparatus to remove nuclear isobars from mass spectrometry of claim 14, wherein the tunable resonance laser comprises a tunable Ti-Sapphire laser and comprises element specific resonant reionization.

16. The apparatus to remove nuclear isobars from mass spectrometry of claim 15, further comprising multiple Ti-Sapphire lasers.

* * * * *